US008408537B2

(12) United States Patent
Katada et al.

(10) Patent No.: US 8,408,537 B2
(45) Date of Patent: Apr. 2, 2013

(54) SHEET REVERSING MECHANISM AND IMAGE FORMING APPARATUS HAVING SHEET REVERSING MECHANISM

(75) Inventors: Yasuhiro Katada, Ibaraki-ken (JP); Atsushi Suzuki, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 641 days.

(21) Appl. No.: 12/654,736

(22) Filed: Dec. 30, 2009

(65) Prior Publication Data

US 2010/0183353 A1 Jul. 22, 2010

(30) Foreign Application Priority Data

Jan. 21, 2009 (JP) ..... P2009-011322

(51) Int. Cl.
*B65H 29/00* (2006.01)

(52) U.S. Cl. ..... 271/184; 271/186; 399/373

(58) Field of Classification Search ..... 271/184, 271/185, 186; 399/401, 373, 374
See application file for complete search history.

(56) References Cited

U.S. PATENT DOCUMENTS

| | | | | |
|---|---|---|---|---|
| 4,627,709 | A * | 12/1986 | Kitajima et al. | 399/374 |
| 4,956,678 | A * | 9/1990 | Kiya et al. | 399/401 |
| 4,990,965 | A * | 2/1991 | Kiya | 399/402 |
| 5,819,152 | A * | 10/1998 | Kobayashi et al. | 399/367 |
| 6,577,844 | B2 * | 6/2003 | Kamei | 399/401 |
| 6,585,258 | B1 * | 7/2003 | Hirota et al. | 271/186 |
| 6,648,320 | B2 * | 11/2003 | Iino et al. | 271/3.15 |
| 6,814,353 | B1 * | 11/2004 | Kakuta et al. | 271/186 |
| 6,836,640 | B2 * | 12/2004 | Isemura et al. | 399/388 |
| 7,020,429 | B2 * | 3/2006 | Hamada et al. | 399/367 |
| 7,389,085 | B2 * | 6/2008 | Kitamura | 399/401 |
| 7,509,088 | B2 * | 3/2009 | Miyake | 399/401 |
| 7,583,926 | B2 * | 9/2009 | Tamehira et al. | 399/388 |

FOREIGN PATENT DOCUMENTS

| | | | |
|---|---|---|---|
| JP | 2001206646 | A | 7/2001 |
| JP | 2001-282050 | A | 10/2001 |
| JP | 2004315166 | A | 11/2004 |
| JP | 2005148650 | A | 6/2005 |
| JP | 2005-280897 | A | 10/2005 |

OTHER PUBLICATIONS

Official Action issued on Jan. 29, 2013 in the counterpart Japanese application No. 2009-011322.

* cited by examiner

*Primary Examiner* — Stefanos Karmis
*Assistant Examiner* — Ernesto Suarez
(74) *Attorney, Agent, or Firm* — Nath, Goldberg & Meyer; Jerald L. Meyer; Scott C. Langford

(57) ABSTRACT

A sheet reversing mechanism for an image forming apparatus including a switchback reverse path for reversing print sheets, including a transfer roller, a drive motor, and a driving force transmission mechanism. The transfer roller transfers a print sheet along the switchback reverse path. The drive motor rotates in a forward direction and in a reverse direction. The driving force transmission mechanism transmits driving force generated by rotation of the drive motor to the transfer roller. The driving force transmission mechanism includes a clutch configured to connect or disconnect transmission of the driving force to the transfer roller.

6 Claims, 8 Drawing Sheets

SHEET REVERSING MECHANISM AND IMAGE FORMING APPARATUS HAVING SHEET REVERSING MECHANISM

CROSS REFERENCE TO RELATED APPLICATION

This application is based upon and claims the benefit of priority from the prior Japanese Patent Application No. 2009-011322, filed on Jan. 21, 2009, the entire contents of which are incorporated herein by reference.

BACKGROUND OF THE INVENTION

1. Field of the Invention

The present invention relates to a sheet reversing mechanism in an image forming apparatus and an image forming apparatus having the sheet reversing mechanism.

2. Description of the Related Art

There has been known a double-sided printer which has a circulating transfer path including a sheet reversing mechanism and which reverses a sheet printed on one side to perform printing on the other side. There has recently been an increasing demand that a printer should have an improved productivity with faster printing speed. To achieve this, the printer is required to perform not only single-side printing but also double-side printing at a high productivity with faster printing speed.

The productivity of the printer depends mostly on a speed of image formation by a printing mechanism and a speed of transferring a print sheet by a transfer mechanism. Japanese Patent Application Publication No. 2005-280897 describes that productivity is improved by controlling, during double-side printing, a sheet transfer speed in circulating transfer according to a sheet size, independently of a sheet transfer speed in printing.

SUMMARY OF THE INVENTION

The image formation by the printing mechanism is the same in both single-side printing and double-side printing. Thus, image formation at a maximum speed of the printing mechanism, which is determined depending on printing conditions such as resolution, can be easily performed in both single-side printing and double-side printing. Here, the sheet transfer speed during printing is determined based on an image formation speed.

However, productivity of the printer depends not only on the image formation speed but also on the number of print sheets to be outputted per unit time. Since in single-side printing, the print sheets can be fed one after another, the sheet transfer speed by the transfer mechanism does not constrain the productivity. Therefore, the print sheets can be outputted by the maximum number of print sheets that the printing mechanism can output per unit time. On the other hand, in double-side printing, back printing is performed by circulatively transferring and reversing the print sheet having its front surface printed. Thus, a circulating transfer speed by the transfer mechanism affects the productivity of the printer. Specifically, an inappropriate circulating transfer speed causes a situation where no print sheet is transferred to the printing mechanism which is ready to perform printing. Thus, the productivity of the printing mechanism can not be fully used to output the print sheets.

Incidentally, in the sheet reversing mechanism, there has been widely used a method for providing a switchback path and revering the print sheet by temporarily stopping the print sheet on the switchback path and transferring the print sheet in an opposite direction. In this case, on the switchback path, such a control is repetitively made that the print sheet that is being transferred is decelerated and stopped, and then the print sheet is transferred in the reverse direction.

After transferring the print sheet in the reverse direction, the sheet reversing mechanism needs to prepare for transferring a next print sheet in a forward direction. When this preparation is delayed, sheet transfer is not smoothly performed and thus a proper circulating transfer speed cannot be achieved. If the transfer in the reverse direction is terminated earlier than needed in order to secure a preparation time, there arises a difference in speed from another sheet transfer mechanism concurrently transferring the same print sheet. Such a difference in speed may adversely affect the sheet transfer.

Particularly, when a compact stepping motor is used in the sheet reversing mechanism to suppress a cost increase caused by the use of a motor capable of accelerating abruptly and stopping abruptly, securing the preparation time is a serious problem. This is because the compact stepping motor requires much time to be accelerated for transferring the next print sheet in the forward direction after transferring the print sheet in the reverse direction.

Therefore, it is an object of the present invention to provide a sheet reversing mechanism achieving a printer with an improved productivity and an image forming apparatus with the sheet reversing mechanism.

To achieve the object, a first aspect of the present invention is a sheet reversing mechanism for an image forming apparatus including a switchback reverse path for reversing print sheets, the sheet reversing mechanism comprising: a transfer roller configured to transfer a print sheet along the switchback reverse path; a drive motor configured to rotate in a forward direction and in a reverse direction; and a driving force transmission mechanism configured to transmit driving force generated by rotation of the drive motor to the transfer roller, wherein the driving force transmission mechanism includes a clutch configured to connect or disconnect transmission of the driving force to the transfer roller.

According to the first aspect, since the sheet reversing mechanism has the clutch, driving force transmission between the motor and the transfer rollers can be allowed or interrupted. Therefore, even before the transfer rollers finish transferring the print sheet in the reverse rotation direction, the motor which drives the transfer rollers can start rotating in the forward direction. Thus, a preparation time to increase the rotation speed of the transfer rollers for transferring the next print sheet can be secured. Moreover, the speed of the transfer rollers is allowed to reach the predetermined speed at a timing faster than that of the conventional sheet reversing mechanism. Thus, the sheet reversing mechanism according to the present invention can transfer the next print sheet faster than the conventional sheet reversing mechanism does. Consequently, the productivity of the printer can be improved.

The drive motor may be a stepping motor.

The above configuration makes it possible to control a transfer distance of the print sheet by regulating the number of pulses to be applied to the stepping motor. Moreover, the use of the small stepping motor can suppress a cost increase. Thus, the productivity of the printer can be improved while suppressing a cost increase caused by the use of a large motor.

The sheet reversing mechanism may further comprise a controller configured to control rotation of the drive motor. And the controller may accelerate and decelerate rotation of the drive motor at a predetermined acceleration.

The above configuration makes it possible to perform so-called a trapezoidal drive of the drive motor so that the drive motor is accelerated or decelerated at a predetermined acceleration at the start and end of rotation, for example.

The sheet reversing mechanism may further comprise a controller configured to control rotation of the drive motor. And the controller may be configured to drive the drive motor to rotate in the reverse direction to transfer a preceding print sheet in a direction of discharging a print sheet from the switchback reverse path in a state where the controller drives the clutch to connect transmission of the driving force, and then drive the clutch to disconnect transmission of the driving force, drive the drive motor to start to rotate in the forward direction in a state where the controller drives the clutch to disconnect transmission of the driving force, and drive the clutch to connect transmission of the driving force to transfer a next print sheet in a direction of guiding a print sheet into the switchback reverse path after a predetermined time has passed since the controller drives the drive motor to start to rotate in the forward direction.

The above configuration makes it possible to control the motor which drives the transfer rollers so that the motor starts rotating in the normal rotation direction in a state where driving force transmission between the motor and the transfer rollers is interrupted by controlling the clutch. Thus, even before the transfer rollers finish transferring the print sheet in the reverse direction, a preparation time to increase the rotation speed of the transfer rollers for transferring the next print sheet can be secured. Moreover, the speed of the transfer rollers is allowed to reach the predetermined speed at a timing faster than that of the conventional sheet reversing mechanism. Thus, the sheet reversing mechanism according to the present invention can transfer the next print sheet faster than the conventional sheet reversing mechanism does. Consequently, the productivity of the printer can be improved.

A second aspect of the present invention is a image forming apparatus comprising: a switchback reverse path for reversing print sheets; and a sheet reversing mechanism including a transfer roller configured to transfer a print sheet along the switchback reverse path, a drive motor configured to rotate in a forward direction and in a reverse direction, and a driving force transmission mechanism configured to transmit driving force generated by rotation of the drive motor to the transfer roller, wherein the driving force transmission mechanism includes a clutch configured to connect or disconnect transmission of the driving force to the transfer roller.

According to the second aspect, the similar effects and advantages to the first aspect can be brought about.

A third aspect of the present invention is a method for reversing print sheets on a switchback reverse path in an image forming apparatus, the method comprising: transferring a print sheet along the switchback reverse path by a transfer roller; driving a drive motor to rotate in a forward direction and in a reverse direction; and connecting or disconnecting transmission of driving force generated by rotation of the drive motor to the transfer roller.

According to the third aspect, the similar effects and advantages to the first aspect can be brought about.

DETAILED DESCRIPTION OF THE EMBODIMENT

Figure 1:
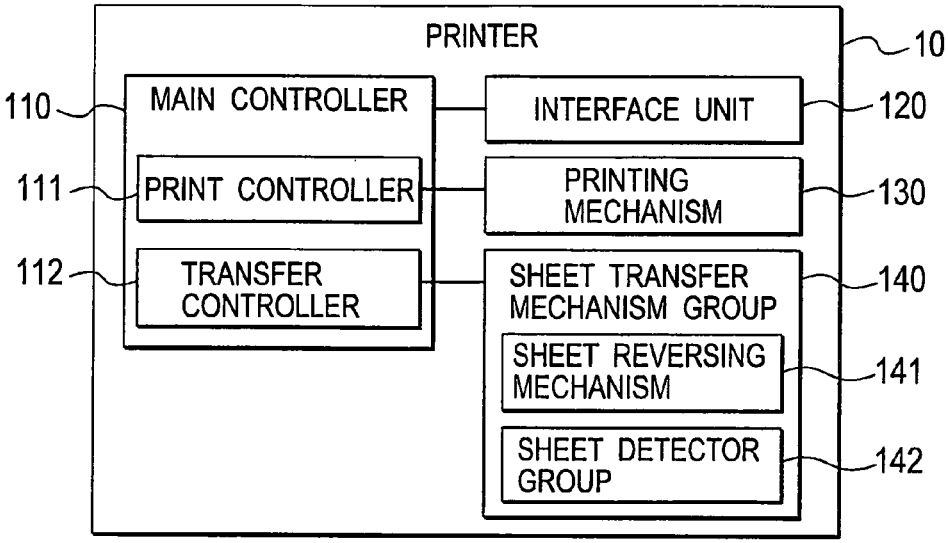
FIG. 1 is a block diagram showing a main functional configuration of a printer according to an embodiment of the present invention.

With reference to the drawings, an embodiment of the present invention will be described in detail. FIG. 1 is a block diagram showing a main functional configuration of a printer 10 according to an embodiment of the present invention. As shown in FIG. 1, the printer 10 includes a main controller 110, an interface unit 120, a printing mechanism 130 and a sheet transfer mechanism group 140.

The main controller 110 consists of a CPU, a memory, an image processing device and the like, and performs control of various kinds of processing in the printer 10 by operating the CPU according to programs stored in the memory, and by operating in other ways. In this embodiment, the main controller 110 includes a print controller 111 configured to control the printing mechanism 130 and a transfer controller 112 configured to control the sheet transfer mechanism group 140.

The interface unit 120 receives print data from an unillustrated computer network connected thereto and performs processing for accepting various settings from a user.

The printing mechanism 130 is a mechanism configured to perform print processing on a print sheet. In this embodiment, an ink jet printing mechanism is used, which is configured to perform printing line by line. The ink jet printing mechanism includes multiple line print heads each having a nozzle formed therein, and performs printing by ejecting black or color ink from each of the print heads. However, the present invention is not limited to the ink jet method but can be applied to printers using other printing methods. For example, the present invention may be applied to a serial ink jet printer, a laser printer, and the like.

The sheet transfer mechanism group 140 is a mechanism group which is configured to perform feeding, transferring and discharging, and the like of print sheets. The sheet transfer mechanism group 140 includes rollers provided along a transfer path, transfer belts, motors configured to drive the rollers and the belts, a driving force transmission mechanism configured to transmit driving force from the motors to the rollers, and the like. Particularly, in this embodiment, the sheet transfer mechanism group 140 includes a sheet reversing mechanism 141 configured to reverse the print sheet for double-side printing, a switchback reverse path provided on the sheet reversing mechanism 141 for allowing the print sheet to pass through when reversing the sheet, and a sheet detector group 142 configured to detect the presence or absence of a sheet transferred along the transfer path.

Figure 2:
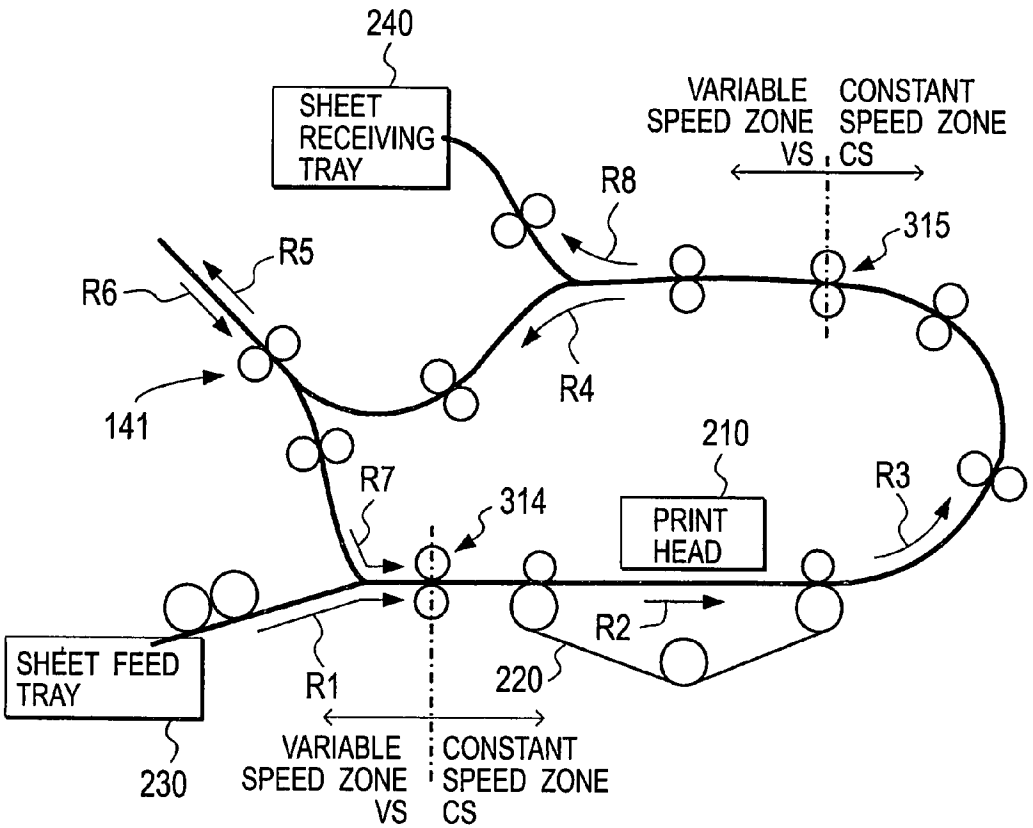
FIG. 2 is a diagram schematically showing a sheet transfer path in the printer according to the embodiment of the present invention.

FIG. 2 is a diagram schematically showing a sheet transfer path in the printer 10. As shown in FIG. 2, a print sheet is fed from a sheet feed tray 230, an image is formed thereon by a print head 210, and then the sheet is discharged onto a sheet receiving tray 240. The sheet transfer path forms a circulating path including the sheet reversing mechanism 141 so as to enable double-side printing. On the upstream side of the print head 210, registration rollers 314 for correcting inclination of the print sheet and adjusting timing are provided.

When the printer 10 performs double-side printing, the print sheet fed from the sheet feed tray 230 is transferred in an arrow R1 direction and then temporarily stopped for the inclination correction and the timing adjustment by the registration roller 314. Thereafter, the registration rollers 314 transfer the print sheet onto a transfer belt 220 provided so as to face the print head 210.

An image is formed line by line on a surface of the print sheet by the print head 210 while the print sheet, sticking to the transfer belt 220, is being transferred in an arrow R2 direction. A transfer speed in this event is determined according to image formation capability of the print head 210 and printing conditions such as resolution of an image to be formed. In the following description, a sheet transfer speed in image formation is assumed to be Vg.

Subsequently, the print sheet is transferred in an arrow R3 direction along the transfer path and further transferred by rollers such as upper-side transfer rollers 315. The print sheet having its front surface printed is guided in an arrow R4 direction without being discharged onto the sheet receiving tray 240. Then, the print sheet is drawn in an arrow R5 direction into the sheet reversing mechanism 141, and is stopped temporarily. Here, the arrow R5 direction is assumed to be a forward direction.

After being temporarily stopped, the print sheet is transferred in an arrow R6 direction by the sheet reversing mechanism 141 and thus reversed with respect to the print head 210. Note that the arrow R6 direction is assumed to be a reverse direction. Thereafter, the print sheet is transferred in an arrow R7 direction and then stopped for inclination correction and timing adjustment by the registration rollers 314. Subsequently, the print sheet is transferred again by the registration rollers 314 onto the transfer belt 220 provided so as to face the print head 210.

An image is formed on a back surface of the print sheet by the print head 210 while the print sheet is transferred in the arrow R2 direction at the speed Vg by the transfer belt 220 with the printed front surface facing down. Thereafter, the print sheet is transferred in the arrow R3 direction along the transfer path and further transferred by rollers such as the upper-side transfer rollers 315. The print sheet printed on both sides thereof is transferred in an arrow R8 direction and then discharged onto the sheet receiving tray 240.

As described above, in a section of the path from the registration rollers 314 to the upper-side transfer rollers 315, the print sheet is transferred at the constant transfer speed Vg which is required in consideration of the image formation capability, printing conditions and the like. This is because the print sheet needs to be transferred at a constant speed during the image formation. This section will be hereinafter referred to as a constant speed zone CS. On the other hand, a section of the path from the upper-side transfer rollers 315 to the registration rollers 314 is a section where the print sheet does not need to be transferred at the constant transfer speed Vg. This section will be hereinafter referred to as a variable speed zone VS. In the variable speed zone VS, the print sheet is basically transferred at a constant speed Vr higher than the transfer speed Vg, except that the print sheet is decelerated, stopped and accelerated by the sheet reversing mechanism 141 and decelerated to be stopped at the registration rollers 314.

Figure 3:
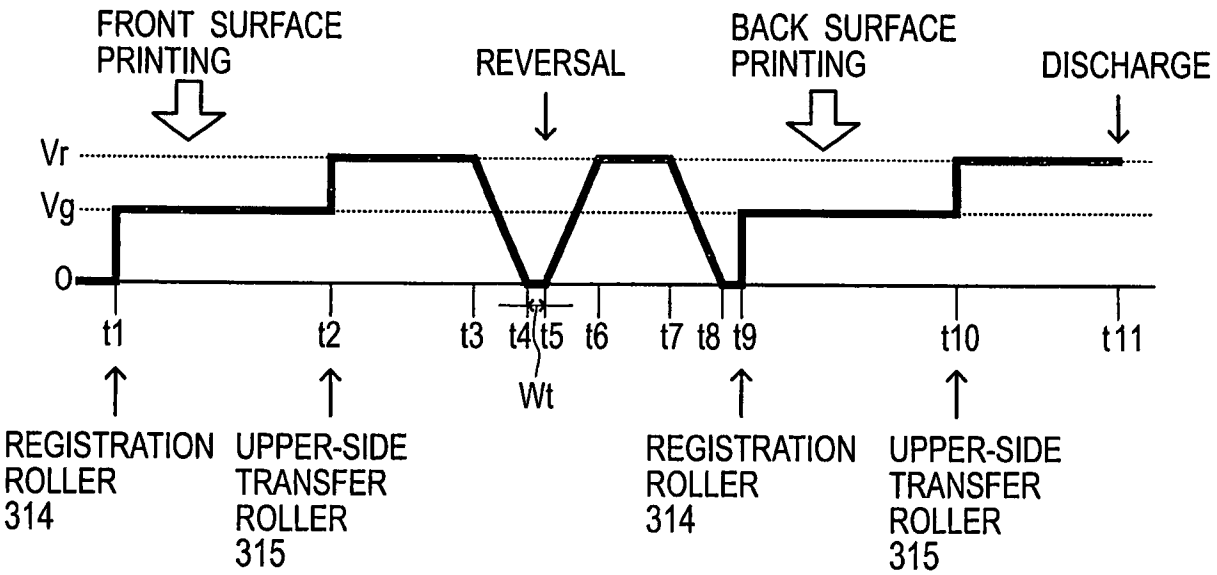
FIG. 3 is a chart showing speed transitions of a print sheet during double-side printing.

Accordingly, the print sheet undergoes speed transitions as shown in FIG. 3. Here, in FIG. 3, a horizontal axis represents time and a vertical axis represents a transfer speed. Specifically, the print sheet transferred at the constant transfer speed Vg from the registration rollers 314 at a time point t1 is subjected to front surface printing and then transferred at the constant circulating transfer speed Vr when reaching the upper-side transfer rollers 315 at a time point t2. The print sheet is decelerated from a time point t3 to reach a speed 0 at a time point t4. Acceleration in this event is $|\alpha|$. Thereafter, during a time period Wt between the time point t4 and a time point t5, the print sheet is temporarily stopped for reversal. Subsequently, the print sheet is accelerated to the transfer speed Vr at the acceleration $|\alpha|$ from the time point t5 to a time point t6 and then transferred at the constant transfer speed Vr until a time point t7. The print sheet is decelerated at the acceleration $|\alpha|$ from the time point t7 to be stopped at the registration rollers 314 and then returned to and temporarily stopped at the registration rollers 314 at a time point t8. Thereafter, the print sheet transferred at the constant transfer speed Vg from the registration rollers 314 at a time point t9 is subjected to back printing and then transferred at the transfer speed Vr when reaching the upper-side transfer rollers 315 at a time point t10. The print sheet is then discharged at a time point t11.

In this embodiment, the printer 10 is configured to be able to continuously perform printing at predetermined time intervals by feeding a next print sheet before discharging a preceding print sheet, not by feeding a certain print sheet and then feeding a next print sheet after the certain print sheet is printed and discharged. Thus, in continuous printing of multiple sheets, multiple print sheets lie on the transfer path in the printer 10. Here, the number of print sheets to be circulatively transferred along the transfer path is set to be a circulating number N. Note, however, that the circulating number N does not necessarily define the number of sheets simultaneously lying on the transfer path, but defines the order of printing of the front and back surfaces in a double-side printing schedule, which will be described later. For example, in the case where the circulating number is N, a front surface of a sheet A is printed and then a back surface of the sheet A is printed after the elapse of a period of time required for transferring other N−1 sheets.

Figure 4:
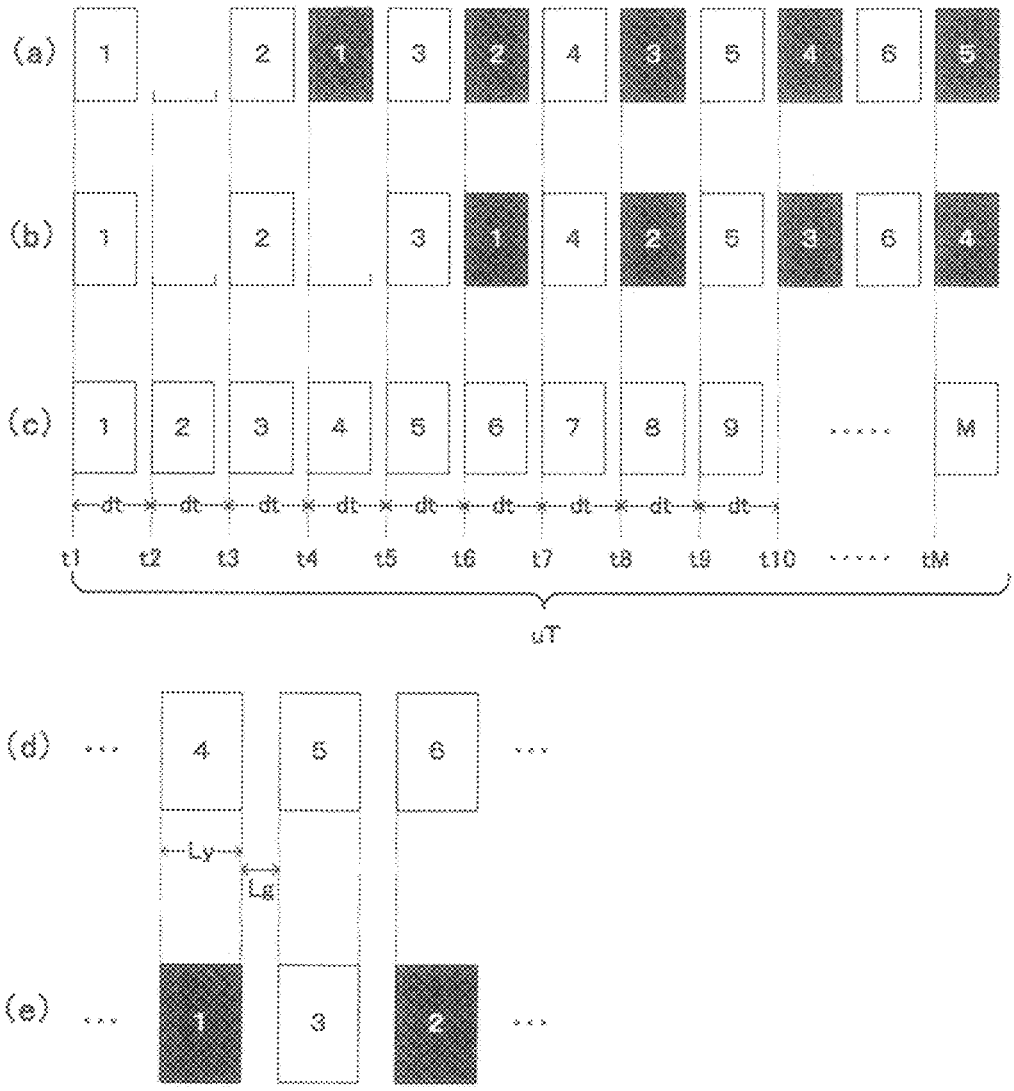
FIGS. 4(*a*) to 4(*e*) are diagrams for explaining a printing schedule.

Next, setting of the speed Vr in the variable speed zone VS will be described. Speed control in the variable speed zone VS is set in accordance with a printing schedule for double-side printing. Thus, the printing schedule will be first described. As described above, before discharging a preceding print sheet, the printer 10 is able to feed a next print sheet. By setting such a printing order of a case where multiple print sheets can be circulated that a front surface of a newly fed print sheet and a back surface of a circulatively transferred print sheet are alternately printed, productivity is improved by (Japanese Patent Application Publication No. 2001-282050, Paragraphs [0070] to [0072] and the like). For example, in the case of N=3, in other words, when three print sheets are circulated, a front surface of a first sheet is printed, a front surface of a second sheet is printed after an idle print time for one sheet, and then a back surface of the circulatively transferred first sheet is printed, as shown in FIG. 4(*a*). Thereafter, a front surface of a third sheet is printed and then a back surface of the circulatively transferred second sheet is printed. After that, a front surface of each newly fed print sheet and a back surface of each circulatively transferred print sheet are alternately printed in the similar manner. However, when feeding of new print sheets is completed at the end of printing, back printing of the circulatively transferred print sheets is performed twice in a row with an idle print time for one sheet interposed between the two back printing operations, and then the printing is finished. Note that, in FIGS. 4(*a*) to 4(*e*), front surface printing of a Kth sheet is indicated by a black K on a white background and back printing of the Kth sheet is indicated by a white K on a black background.

In the case of N=5, in other words, when five print sheets are circulated, a front surface of a first sheet is printed, a front surface of a second sheet is printed after an idle print time for one sheet, a front surface of a third sheet is further printed after an idle print time for one sheet, and then a back surface of the circulatively transferred first sheet is printed, as shown in FIG. 4(*b*). Thereafter, a front surface of a fourth sheet is printed and then a back surface of the circulatively transferred second sheet is printed. After that, a front surface of each newly fed print sheet and a back surface of each circulatively transferred print sheet are alternately printed in the similar manner. However, when feeding of new print sheets is completed at the end of printing, back printing of the circulatively transferred print sheets is performed three times in a row with idle print times each for one sheet respectively interposed between the first and the second back printing operation and between the second and the third back printing operation, and then the printing is finished.

It is assumed that the printer 10 can perform single-side printing for M sheets, for example, within a predetermined time uT as shown in FIG. 4(*c*). In this case, a time period between start of printing of a first sheet and start of printing of a second sheet is assumed to be dt. In the single-side printing, since print sheets can be fed one after another, the printer 10 can perform printing easily with the maximum productivity of the printing mechanism thereof. Specifically, the printer 10 only has to transfer the print sheets at such a printing speed and at sheet intervals, at which the printing mechanism can perform printing, such that required printing quality and the like can be maintained. Here, as shown in FIG. 4(*d*), a distance between two sheets during the single-side printing is assumed to be Lg. Since a length of the print sheet in the transfer direction is Ly, a distance of each print sheet including the distance between two sheets is Ly+Lg.

As shown in FIG. 4(*c*), the printer 10 has the productivity of the print time dt per sheet during the single-side printing. If double-side printing can be performed with the equivalent productivity as that described above, in other words, with the print time dt for one side, this means that double-side printing is performed with the maximum productivity of the printer 10. However, at the start and end of the double-side printing, there inevitably arise a period during which front surface printing is consecutively performed and a period during which back surface printing is consecutively performed, each period having the idle print time dt for one print sheet interposed therein. Thus, an actual target for realizing the maximum productivity of the printer 10 is a period during which face printing and back printing are alternately performed.

In order to realize the productivity, the print sheets may be circulated within a time period 3×dt when N=3, because the first print sheet front surface printing of which is started at t1, for example, is circulated to have back printing thereof started at t4, as shown in FIG. 4(*a*). Meanwhile, the print sheets may be circulated within a time period 5×dt when N=5, because the first print sheet front surface printing of which is started at t1 is circulated to have back printing thereof started at t6, as shown in FIG. 4(*b*). Specifically, when the number of sheets to be circulated is N, the print sheets may be circulated within a time period N×dt.

The print time dt is obtained by dividing the sum of the widths Ly of the print sheet and the sheet intervals by the sheet transfer speed. Here, the sheet transfer speed in printing is equal to Vg in both double-side printing and single-side printing. Thus, to perform the double-side printing with the equivalent productivity per side as that in the single-side printing, the sheet interval in the double-side printing is required to be equal to the sheet interval Lg in the single-side printing, as shown in FIG. 4(*e*). This means that, to perform the double-side printing with the equivalent productivity per side as that in the single-side printing, the circulating transfer speed Vr may be set so as to allow the print sheet to be circulated within the time N×(Ly+Lg)/Vg.

Figure 5:
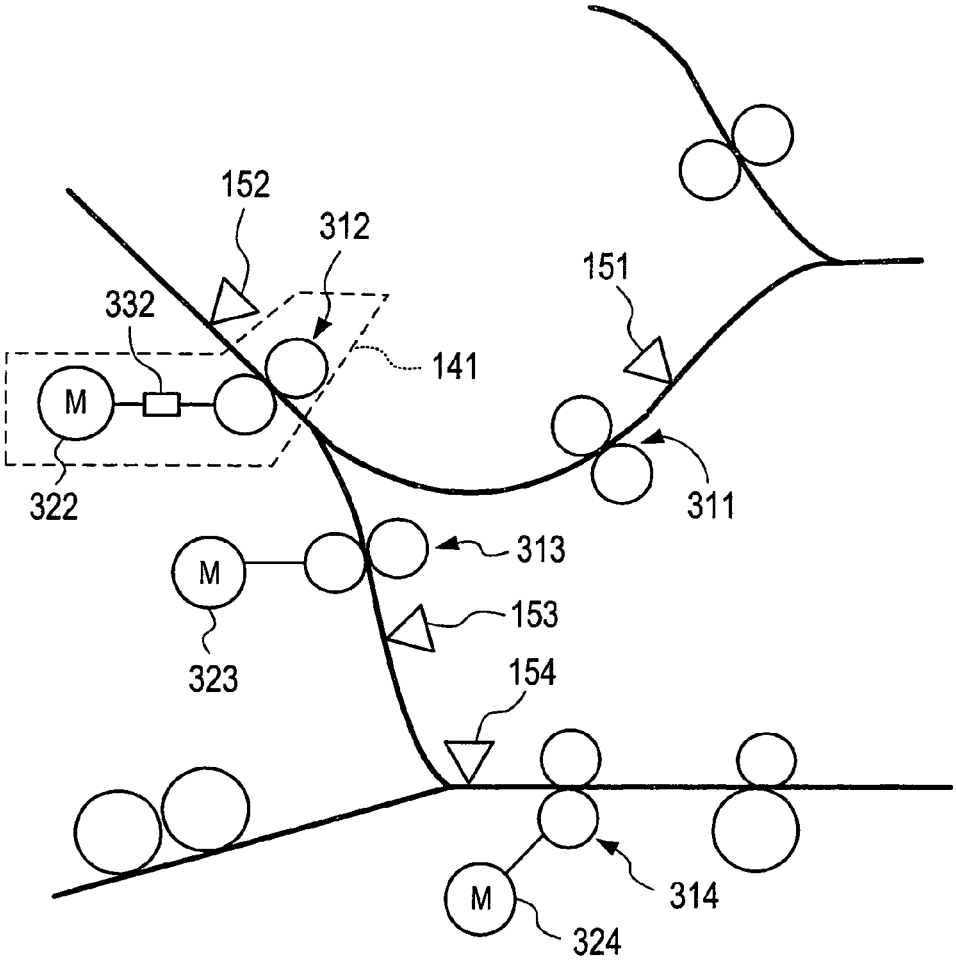
FIG. 5 is a diagram schematically showing details of a sheet transfer mechanism group around a sheet reversing mechanism.

Next, the sheet reversing mechanism 141 in this embodiment will be described. FIG. 5 is a diagram schematically showing details of the sheet transfer mechanism group 140 around the sheet reversing mechanism 141. As shown in FIG. 5, the sheet reversing mechanism 141 includes switchback rollers 312 and a switchback motor 322 to be a drive source for the switchback rollers 312. On the upstream side of the switchback rollers 312, upper-side transfer exit rollers 311 are provided. On the upstream side of the upper-side transfer exit rollers 311, an upper-side transfer exit sensor 151 is provided, which detects the presence or absence of a print sheet. On the forward side of the switchback rollers 312, a switchback sensor 152 is provided.

On the downstream side of the switchback rollers 312, sheet refeed rollers 313 for guiding a reversed print sheet again to the registration rollers 314 are provided. The sheet refeed rollers 313 are driven by a sheet refeed motor 323. On the downstream side of the sheet refeed rollers 313, a sheet refeed sensor 153 is provided. The registration rollers 314 are driven by a registration motor 324. On the upstream side of the registration rollers 314, a registration sensor 154 is provided. The sensors constitute the sheet detector group 142 and output on signals when detecting passage of a sheet.

The switchback motor 322 and the sheet refeed motor 323 can be formed of stepping motors, for example, and can control a transfer distance of the print sheet by adjusting the number of pulses to be applied. In this embodiment, compact stepping motors are used to suppress a cost increase. The compact stepping motors are subjected to so-called a trapezoidal drive in which the motors are accelerated by a predetermined acceleration at the start of rotation and decelerated at the end of rotation. Alternatively, DC motors and the like may be used. In this case, an encoder, for example, is provided to enable detection of a transfer distance of the print sheet.

In this embodiment, in a drive transmission mechanism including the switchback motor 322 and the switchback rollers 312, a switchback clutch 332 is provided to enable ON/OFF switching of driving force transmission from the switchback motor 322 to the switchback rollers 312. An electromagnetic clutch, for example, can be used as the switchback clutch 332, and the transfer controller 112 controls ON and OFF of the switchback clutch 332. In this embodiment, even in a state where the switchback rollers 312 is not finished transferring the print sheet in the reverse direction, the switchback motor 322 can start rotating in the forward direction without adversely affecting sheet transfer by turning off the switchback clutch 332. Thus, time required for acceleration in the forward direction can be previously secured. Note that the switchback clutch 332 is not limited to the electromagnetic clutch as long as the clutch can switch ON and OFF of the driving force transmission.

By turning on the switchback clutch 332 in a state where the switchback motor 322 has reached the transfer speed Vr, the switchback rollers 312 can smoothly take over the print sheet transferred from the upper-side transfer exit rollers 311. Thus, the print sheet transfer interval in the circulating transfer path can be shortened in the sheet reversing mechanism 141 of this embodiment, compared with the conventional sheet reversing mechanism without a clutch that has to cause the switchback motor 322 to rotate in the forward direction after waiting for the switchback rollers 312 to finish transferring the print sheet in the reverse direction.

Figure 6A:
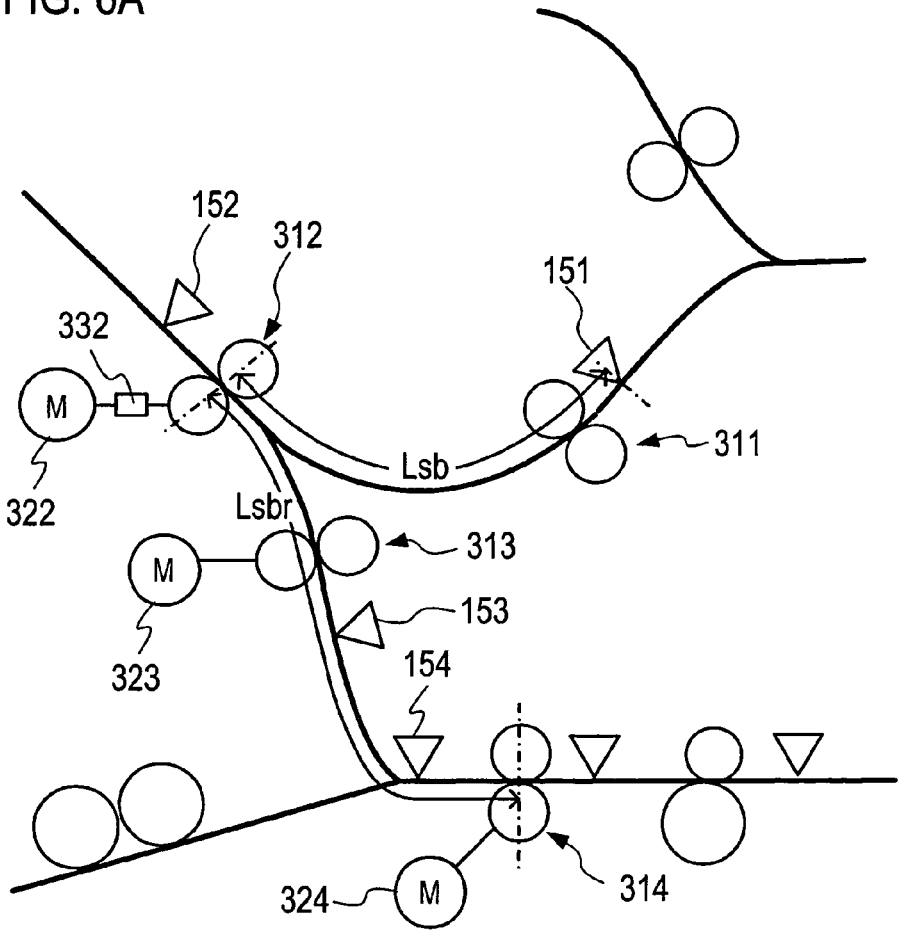
FIGS. 6A and 6B are diagrams for explaining a distance referred to in this embodiment.
Figure 6B:
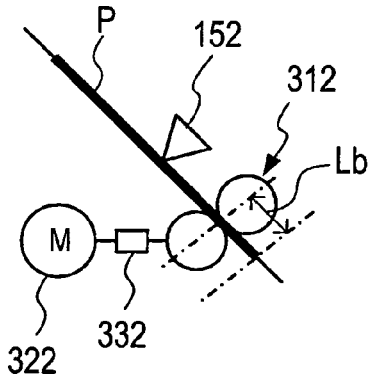

FIGS. 6A and 6B are diagrams for explaining a distance referred to in this embodiment. As shown in FIG. 6A, it is assumed that a distance between the upper-side transfer exit sensor 151 and the switchback rollers 312 along the transfer path is Lsb and a distance between the switchback rollers 312 and the registration rollers 314 is Lsbr. The distances Lsb and Lsbr are fixed values determined in designing the printer 10. Moreover, when the switchback rollers 312 are to reverse the print sheet, the switchback rollers 312 stop the print sheet temporarily. In this event, the print sheet P is stopped with a predetermined distance thereof left backward so as not to be detached from the switchback rollers 312 and so as to be ready to be transferred to the sheet refeed rollers 313 in reversal thereof, as shown in FIG. 6B. This distance is assumed to be Lb.

Figure 7A:
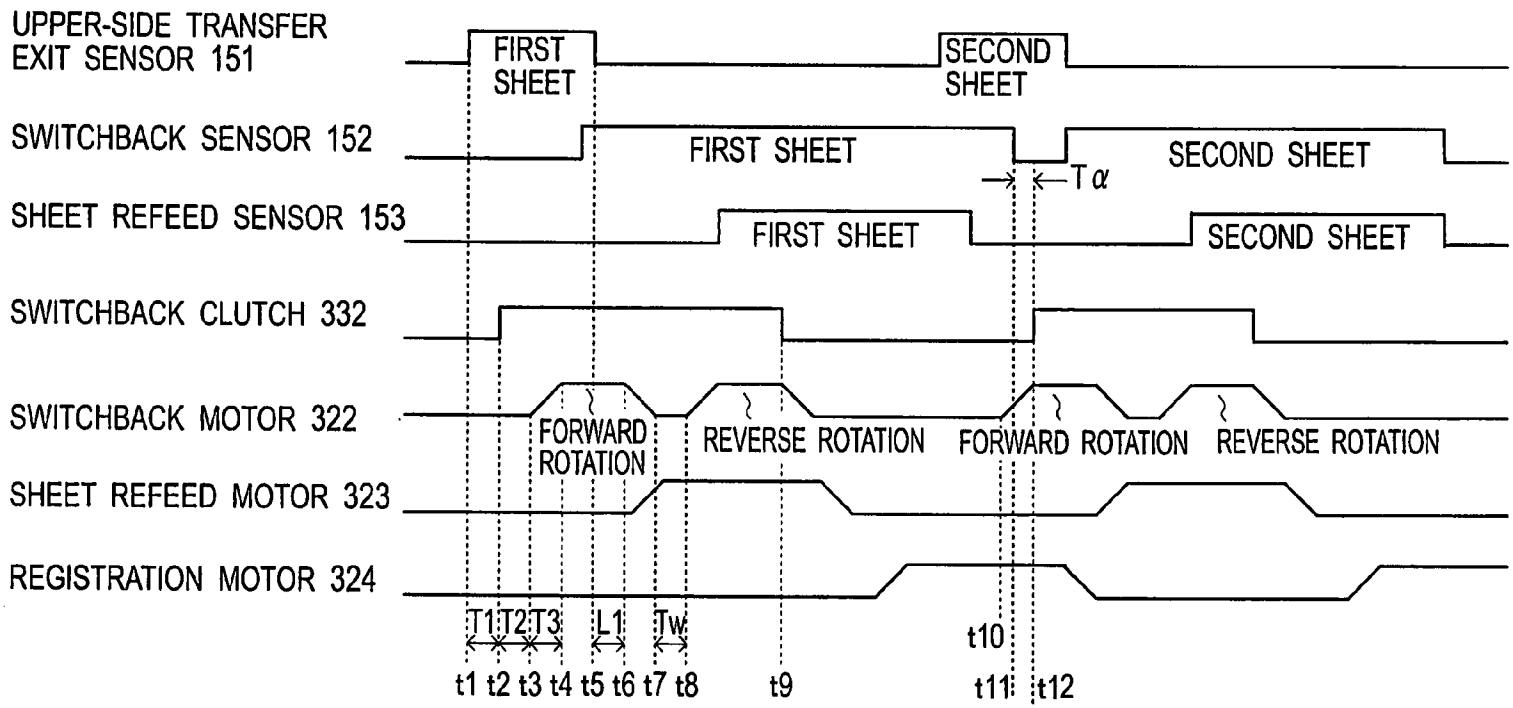
FIGS. 7A and 7B are timing charts for explaining control of a switchback clutch and a switchback motor.
Figure 7B:
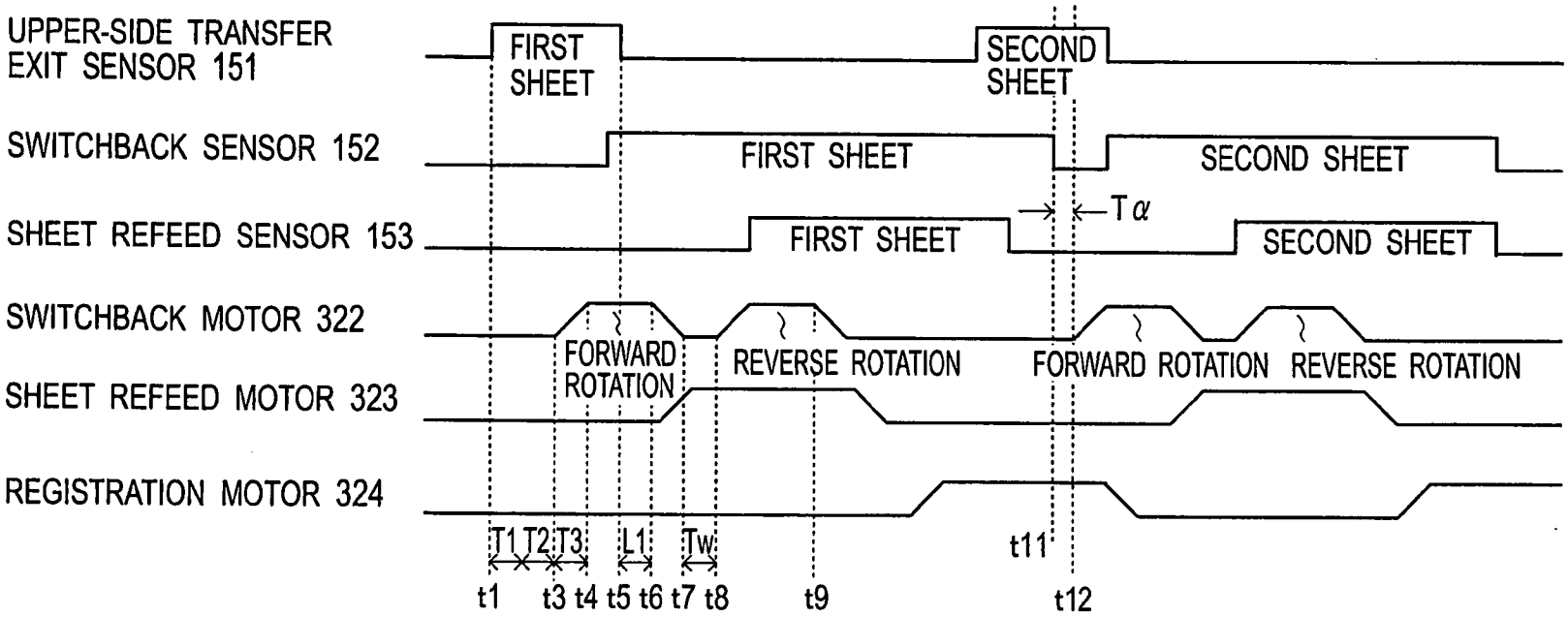
FIG. 7B PRIOR ART

FIG. 7A shows timing charts of the sheet transfer mechanism group of this embodiment provided with the switchback clutch 332, and FIG. 7B shows timing charts of the conventional sheet transfer mechanism group not provided with the switchback clutch 332. With reference to the timing charts shown in FIGS. 7A and 7B, a control example and effects of the switchback clutch 332 and the switchback motor 322 in this embodiment and a control example of the conventional sheet transfer mechanism group will be described while comparing these two. FIG. 7A shows control timings of the switchback clutch 332, the switchback motor 322, the sheet refeed motor 323, and the registration motor 324 for output results of the upper-side transfer exit sensor 151, the switchback sensor 152, and the sheet refeed sensor 153. FIG. 7B shows control timings of the upper-side transfer exit sensor 151, the switchback sensor 152, the sheet refeed sensor 153, the switchback motor 322, the sheet refeed motor 323 and the registration motor 324. Note that, here, for better understanding, description will be given with the same reference numerals as those in this embodiment denoting the corresponding parts in the conventional sheet transfer mechanism group. Here, in FIGS. 7A and 7B, a horizontal axis represents time. A vertical axis represents ON and OFF for each of the upper-side transfer exit sensor 151, the switchback sensor 152, the sheet refeed sensor 153, and the switchback clutch 332 whereas a vertical axis represents a rotation speed for each of the switchback motor 322, the sheet refeed motor 323 and the registration motor 324. In this embodiment, assumed is the case where the length Ly of the print sheet in the transfer direction is longer than the distance Lsbr between the switchback rollers 312 and the registration rollers 314. Specifically, the print sheet reversed by the switchback rollers 312 cannot be pulled out of the switchback rollers 312 until the print sheet is further transferred after reaching the registration rollers 314.

In this embodiment, the switchback rollers 312 need to be rotated at the same speed as the transfer speed Vg of the upper-side transfer exit rollers 311 at the time when the print sheet reaches the switchback rollers 312 in order to smoothly take over the print sheet from the upper-side transfer exit rollers 311 during forward operation. In this case, it is required to take into consideration an acceleration time required to reach the transfer speed Vg from a stopped state.

Therefore, when printing is started and the upper-side transfer exit sensor 151 outputs an on signal upon detection of a front end of the transferred first print sheet at a time point t1, the transfer controller 112 turns on the switchback clutch 332 at a time point t2 after a lapse of a time period T1 and also starts a forward operation of the switchback motor 322 at a time point t3 after a lapse of a time period T2. Here, the acceleration for activating and stopping the switchback motor 322 is set to a to which a value is predetermined.

T1 is calculated in accordance with Formula 1 and a predetermined time period is determined as T2. Specifically, the switchback clutch 332 is turned on at a time point t2 earlier by the predetermined time period T2 than the time point t3 to start the forward operation of the switchback motor 322. However, this timing does not need to be strictly set for the first print sheet.

$$T1 = \frac{Lsb}{Vr} - \frac{Vr}{\alpha} - T2 - Tm \qquad \text{(Formula 1)}$$

Here, the first term on the right side is the time required for the print sheet to be transferred from the upper-side transfer exit sensor 151 to the switchback rollers 312, the second term on the right side is the time required for the switchback rollers 312 to reach the rotation speed Vr from the stopped state, the third term on the right side is the time required to start the forward operation of the switchback motor 322, and the fourth term on the right side is a predetermined margin. Specifically, the higher the transfer speed Vr, the earlier the switchback rollers 312 has to be activated. Thus, the value of T1 is reduced.

Thereafter, the forward operation of the switchback rollers 312 is started at the time point t3 after a lapse of the time period T2 from the time point t2. Subsequently, the speed of the switchback motor 322 reaches Vr at a time point t4 after a lapse of a time period Vr/α(T2), and the speed is maintained. Accordingly, the switchback rollers 312 have already reached the rotation speed Vr when the print sheet is transferred thereto at the transfer speed Vr. Thus, the switchback rollers 312 can smoothly take over the transfer of the print sheet.

Next, at a time point t5, when the upper-side transfer exit sensor 151, after being turned off, outputs an off signal upon detection of a back end of the transferred print sheet, the transfer controller 112 calculates a deceleration start transfer length L1 of the switchback motor 322. L1 is calculated in accordance with Formula 2.

$$L1 = Lsb - Lb - \frac{Vr^2}{2\alpha} \qquad \text{(Formula 2)}$$

Here, the first term on the right side is a distance between the upper-side transfer exit sensor 151 and the switchback rollers 312, the second term on the right side is a remaining length of the rear end of the print sheet in the switchback rollers 312, and the third term on the right side is a transfer distance during deceleration.

After the upper-side transfer exit sensor 151 is turned off at the time point t5, deceleration of the switchback motor 322 performing the forward operation at the speed Vr is started at a time point t6 when the print sheet has been transferred for the distance L1. An acceleration in this event is α. Note that the sheet refeed motor 323 starts its rotation approximately at this timing and, when the speed thereof reaches Vr, the speed is maintained.

The switchback motor 322 is stopped at a time point t7 when a time period Vr/α has passed since the start of deceleration of the switchback motor 322. Accordingly, the print sheet is stopped while leaving the rear end by Lb from the switchback rollers 312.

Then, the switchback motor 322 is stopped for a waiting time period (Tw) previously set for starting a reversal operation, and then a reverse rotating operation of the switchback motor 322 is started at a time point t8 after a lapse of the waiting time period (Tw). An acceleration in this event is also α. Thus, the print sheet is switched back and, when the switchback motor 322 reaches the transfer speed Vr, the switchback motor 322 transfers the print sheet to the sheet refeed rollers 313 at a constant speed.

Subsequently, the switchback clutch 332 is turned off at a time point t9 after the print sheet is handed over to the sheet refeed rollers 313. After that, the operation of the switchback motor 322 will have no influence on the switchback rollers 312 until the switchback clutch 332 is turned on again. Thus, even before the switchback rollers 312 finish transferring the print sheet to the registration rollers 314, a forward operation of the switchback motor 322 can be started.

The switchback sensor 152 is turned off at a time point t11, and the first print sheet passes through the switchback rollers 312 at a time point t12 after a lapse of a time period Tα. Immediately after that, the second print sheet is transferred at the speed Vr. Thus, the switchback motor 322 needs to start its forward operation as soon as possible and to reach the transfer speed Vr for the second print sheet. Here, Tα is the time determined based on the distance between the switchback sensor 152 and the switchback rollers 312 and the transfer speed Vr.

In this embodiment, by turning off the switchback clutch 332, the forward operation of the switchback motor 322 can be started at a time point t10 before the first print sheet passes through the switchback rollers 312.

Subsequently, after it is confirmed that the switchback sensor 152 is turned off at the time point t11 and the first print sheet passes through the switchback rollers 312 at t12 after a lapse of the time period Tα, the switchback clutch 332 is turned on. In this event, the switchback motor 322 has already started its forward operation at the time point t10. Thus, the switchback rollers 312 can rotate at the transfer speed Vr at the time point t12. In this manner, a preparation time required to smoothly take over the print sheet from the upper-side transfer exit rollers 311 can be previously secured.

On the other hand, in the conventional sheet reversing mechanism without the switchback clutch 332, as shown in FIG. 7B, a forward operation of the switchback motor 322 needs to be started at the time point t12 after the first print sheet passes through the switchback rollers 312. This is for preventing both the switchback rollers 312 and the registration rollers 314 from pulling together the print sheet in opposite directions. Accordingly, in the conventional sheet reversing mechanism, the time required for the switchback rollers 312 to reach the transfer speed Vr is longer than that in the sheet reversing mechanism according to this embodiment.

As described above, according to this embodiment, the switchback clutch 332 is provided as the driving force transmission mechanism between the switchback motor 322 and the switchback rollers 312 so that transmission of driving force can be connected or disconnected. Thus, the switchback motor 322 can be rotated in a state where no driving force is transmitted to the switchback rollers 312, that is, without affecting sheet transfer. As a result, even before the switchback rollers 312 finishes transferring the print sheet in the reverse direction, switchback motor 322 which drives the switchback rollers 312 can start rotating in the forward direction. Moreover, when the rotation speed of the switchback motor 322 is increased to a predetermined speed (Vr in this embodiment), the driving force can be transmitted to the switchback rollers 312. Thus, a preparation time to increase the rotation speed of the switchback rollers 312 for transferring the next print sheet can be secured in advance. Moreover, the rotation speed of the switchback rollers 312 is allowed to reach the predetermined speed at a timing faster than that of the conventional sheet reversing mechanism. Thus, the sheet reversing mechanism 141 according to the present invention can perform transfer of the next print sheet faster than the conventional sheet reversing mechanism does. Consequently, productivity of the printer can be improved. Specifically, the present invention provides the sheet reversing mechanism having improved productivity of the printer and an image forming apparatus including the sheet reversing mechanism.

A sheet reversing mechanism and an image forming apparatus having the sheet reversing mechanism according to the embodiment of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiment of the present invention are only a list of optimum effects achieved by the present invention. Hence, the effects of the present invention are not limited to those described in the embodiment of the present invention.

What is claimed is:

1. A sheet reversing mechanism for an image forming apparatus including a switchback reverse path for reversing print sheets, the sheet reversing mechanism comprising:

a transfer roller configured to transfer a print sheet along the switchback reverse path;

a drive motor configured to rotate in a forward direction and in a reverse direction; and a driving force transmission mechanism configured to transmit driving force generated by rotation of the drive motor to the transfer roller, wherein the driving force transmission mechanism includes a clutch configured to connect or disconnect transmission of the driving force to the transfer roller, and a controller configured to control rotation of the drive motor, wherein the controller is configured to drive the drive motor to rotate in the reverse direction to transfer a preceding print sheet in a direction of discharging a print sheet from the switchback reverse path in a state where the controller drives the clutch to connect transmission of the driving force, and then drive the clutch to disconnect transmission of the driving force, drive the drive motor to start to rotate in the forward direction in the state where the controller drives the clutch to disconnect transmission of the driving force, and drive the clutch to connect transmission of the driving force to transfer a next print sheet in a direction of guiding a print sheet into the switchback reverse path after a predetermined time has passed since the controller drives the drive motor to start to rotate in the forward direction.

2. The sheet reversing mechanism according to claim 1, wherein the drive motor is a stepping motor.

3. The sheet reversing mechanism of according to claim 1, wherein the controller accelerates and decelerates rotation of the drive motor at a predetermined acceleration.

4. An image forming apparatus comprising:

a switchback reverse path for reversing print sheets; and a sheet reversing mechanism including a transfer roller configured to transfer a print sheet along the switchback reverse path, a drive motor configured to rotate in a forward direction and in a reverse direction, and a driving force transmission mechanism configured to transmit driving force generated by rotation of the drive motor to the transfer roller, wherein the driving force transmission mechanism includes a clutch configured to connect or disconnect transmission of the driving force to the transfer roller, and wherein the sheet reversing mechanism further includes a controller configured to control rotation of the drive motor, and the controller is configured to drive the drive motor to rotate in the reverse direction to transfer a preceding print sheet in a direction of discharging a print sheet from the switchback reverse path in a state where the controller drives the clutch to connect transmission of the driving force, and then drive the clutch to disconnect transmission of the driving force, drive the drive motor to start to rotate in the forward direction in the state where the controller drives the clutch to disconnect transmission of the driving force, and drive the clutch to connect transmission of the driving force to transfer a next print sheet in a direction of guiding a print sheet into the switchback reverse path after a predetermined time has passed since the controller drives the drive motor to start to rotate in the forward direction.

5. A method for reversing print sheets on a switchback reverse path in an image forming apparatus, the method comprising:

transferring a print sheet along the switchback reverse path by a transfer roller;

driving a drive motor to rotate in a forward direction and in a reverse direction;

connecting or disconnecting transmission of driving force generated by rotation of the drive motor to the transfer roller;

driving the drive motor to rotate in the reverse direction to transfer a preceding print sheet in a direction of discharging a print sheet from the switchback reverse path in a state where transmission of the driving force is connected, and then disconnecting transmission of the driving force;

driving the drive motor to start to rotate in the forward direction in a state where transmission of the driving force is disconnected; and connecting transmission of the driving force to transfer a next print sheet in a direction of guiding a print sheet into the switchback reverse path after a predetermined time has passed since the start of rotation of the drive motor in the forward direction.

6. The method for reversing a print sheet, according to claim 5, wherein in the step of driving the drive motor to rotate, rotation of the drive motor is accelerated and decelerated at a predetermined acceleration.

* * * * *